US005623182A

United States Patent [19]

Okano et al.

[11] Patent Number: 5,623,182

[45] **Date of Patent: *Apr. 22, 1997**

[54] REFLECTIONS MODE ALKALI PHOTOCATHODE AND PHOTOMULTIPLIER USING THE SAME

[75] Inventors: Kazuyoshi Okano; Takehiro Iida; Tetsuo Murata; Nobuharu Suzuki; Hiroaki Washiyama; Yasushi Watase, all of Hamamatsu, Japan

[73] Assignee: Hamamatsu Photonics K.K., Hamamatsu, Japan

[ * ] Notice: The term of this patent shall not extend beyond the expiration date of Pat. No. 5,557,166.

[21] Appl. No.: 630,729

[22] Filed: Apr. 10, 1996

Related U.S. Application Data

[63] Continuation of Ser. No. 121,903, Sep. 16, 1993, abandoned.

[30] Foreign Application Priority Data

| | | | |
|---|---|---|---|
| Jun. 11, 1992 | [JP] | Japan | 4-152094 |
| Feb. 2, 1993 | [JP] | Japan | 5-015530 |
| Jun. 3, 1993 | [JP] | Japan | 5-133668 |

[51] Int. Cl.[6] ..... H01J 1/34; H01J 43/08

[52] U.S. Cl. ..... 313/532; 313/542; 313/530; 250/207

[58] Field of Search ..... 313/527, 528, 313/530, 532, 103 R, 103 CM, 105 R, 105 CM; 250/207

[56] References Cited

U.S. PATENT DOCUMENTS

| | | | |
|---|---|---|---|
| 2,264,717 | 12/1941 | Ruedy et al. | 445/11 |
| 3,498,834 | 3/1970 | Rome et al. | 313/542 |
| 3,771,004 | 11/1973 | Plumeau | 313/536 |
| 3,867,662 | 2/1975 | Endriz | 313/542 |
| 4,002,735 | 1/1977 | Ruedy | 445/10 |
| 4,039,887 | 8/1977 | McDonie | 313/532 X |
| 4,160,185 | 7/1979 | Tomasetti et al. | 313/542 |
| 4,311,939 | 1/1982 | Faulkner et al. | 313/542 |
| 4,339,469 | 7/1982 | McDonie et al. | 427/74 |
| 4,341,427 | 7/1982 | Tomasetti et al. | 313/542 |
| 4,419,603 | 12/1983 | Nussli et al. | 313/532 X |
| 4,623,785 | 11/1986 | L'hermite | 313/532 X |
| 4,914,349 | 4/1990 | Matsui et al. | 313/532 X |
| 5,336,966 | 8/1994 | Nakatsugawa et al. | 313/532 |

FOREIGN PATENT DOCUMENTS

| | | |
|---|---|---|
| 0532358 | 3/1993 | European Pat. Off. . |
| 0567297 | 10/1993 | European Pat. Off. . |

OTHER PUBLICATIONS

Huen, T. et al., "S–11 and S–20 Photocathode Research Activity," SPIE, vol. 49 High Speed Photography (Strasbourg 1984), pp. 287–293.

Dolizy, P., "High Performance with Trailkaline Antimonide Photocathodes," Advances in Electronics and Electron Physics, vol. 74, pp. 331–338. (1988).

Dolizy, P., "Composition et propriétés de transport électronique des couches de $Na_2KSb,Cs$," ACTA Electronica, 27,3–4, 1987, pp. 181–190.

Dolizy, P., "Growth of alkali–antimonide films for photocathodes," Philips Technical Review, vol. 40, (1982) No. 1, Eindhoven, Nederland.

*Primary Examiner*—Sandra L. O'Shea
*Assistant Examiner*—Ashok Patel
*Attorney, Agent, or Firm*—Cushman Darby & Cushman, IP Group of Pillsbury Madison & Sutro, LLP

[57] ABSTRACT

This invention relates to an improvement of a reflection mode alkali photocathode which relies on controlling a deposition weight of antimony. The reflection mode alkali photocathode according to this invention includes a thin layer of antimony directly deposited on a base substrate and activated by alkali metals. The thin film of antimony is deposited in a thickness of below 100 $\mu g/cm^2$. This reflection mode photocathode is suitably usable in photomultipliers. As the base substrate, nickel, aluminium and stainless, etc. are used. As the alkali metals, cesium, potassium, sodium and rubidium are usable.

2 Claims, 6 Drawing Sheets

REFLECTIONS MODE ALKALI PHOTOCATHODE AND PHOTOMULTIPLIER USING THE SAME

This is a continuation of Application No. 08/121,903, filed on Sep. 16, 1993, which was abandoned.

BACKGROUND OF THE INVENTION

1. Field of the Invention

This invention relates to a reflection mode alkali (bialkali or multialkali) photocathode, and a photomultiplier using the same.

2. Related Background Art

Conventional photocathodes include a transmission mode photocathode which emits electrons to the side opposite side of light incidence, i.e., converts incident photons into photoelectron and transmits the photoelectron, and a reflection mode photocathode which emits photoelectron to the side of light incidence, i.e., converts incident photons into photoelectron and emits the photoelectron back to the side of light incidence. The reflection mode photocathode comprises a base substrate made mainly of a metal. Reflection mode bialkali photocathode and reflection mode multialkali photocathode having the base substrates of nickel (Ni) are known. In the reflection mode bialkali photocathode, antimony (Sb) is deposited on a Ni base substrate and is activated by alkali metals of potassium (K) and cesium (Cs). In the multialkali photocathode surface as well, Sb is deposited on a Ni base substrate and is activated by K, Cs and sodium (Na). The Sb deposition amount has been generally above 200 μg/cm$^2$ as will be explained later.

In the above-mentioned conventional reflection mode alkali photocathode, e.g., bialkali photocathode, the radiant sensitivity is about $S_k$=80 μA/Lm. Even in a reflection mode bialkali photocathode having an intermediate layer between the Sb layer and the base substrate, its radiant sensitivity is $S_k$=120 μA/Lm at maximum. Here μA/Lm represents a sensitivity in the unit of lumen. Alumen is a unit of luminous flux based on the visual sensitivity, and 1 Lm/m$^2$=1 Lux. The radiant sensitivity $S_k$ corresponds to a current density of the photocathode given when an intensity of incident light is expressed by Watts.

The photomultiplier is used in the field of measuring feeble light. Properties of the photomultiplier are exhibited in the limit region where light to be detected is counted in photons. Accordingly even some percentage of sensitivity improvement is significant.

SUMMARY OF THE INVENTION

From this viewpoint, the inventors, made studies, and found that a good reflection mode alkali photocathode can be realized by controlling the deposition weight of Sb.

The reflection mode alkali photocathode according to this invention comprises a thin layer of antimony deposited on a base substrate, and activated by a plurality of kinds of alkali metals, in which the thin layer of antimony being deposited in an amount below 100 μg/cm$^2$ and activated by the alkali metals. The reflection mode alkali photocathode according to this invention is suitably usable in photomultipliers.

In the reflection mode alkali photocathode according to this invention, the thin layer of Sb activated by the alkali metals is deposited sufficiently thin. This is a drastic change of a conventional idea involved in the conventional reflection mode photocathode. That is, a reduction of a 200 μg/cm$^2$ deposition amount of the conventional Sb layer of the conventional reflection mode photocathode μg/cm$^2$ to below 100 μg/cm$^2$ can produce sufficiently satisfactory results.

To improve photosensitivities of the photocathode including Sb, the selection of materials of the base substrate of the photocathode surface, the improvement of the surface treatment of the photocathode, and the fabrication conditions, such as temperatures and degrees of vacuum for activating the photocathode surface with alkali metals have been tried.

However, the inventors, noticed that varying the deposition weight of Sb, which is means completely different from the above-mentioned means, can improve photosensitivity and made studies of it. The inventors believe that nobody has studied this means nor published results of such studies. The inventors discovered that photosensitive of the photocathode is very dependent on deposition weights of Sb. First, they analyzed by an electron balance the deposition weights of the Sb of photomultipliers (hereinafter called "PMT") marketed by Hamamatsu Photonics K.K. The results of their analyses show that the deposition weights of the reflection mode photocathode of both multialkali and bialkali types are about 200 μg/cm$^2$.

Then, the inventors, fabricated for tests PMTs having various Sb deposition weights and studied the deposition weight dependency of the radiant sensitivity. The inventors found that the photocathode of these PMTs have peak photosensitivies at about 40 μg/cm$^2$ and are superior to the conventional photocathode.

That is, the inventors experimentally proved that sufficient radiant sensitivities can be obtained in a Sb deposition weight range of 10 μg/cm$^2$–100 μg/cm$^2$. As for radiant sensitivities at below 10 μg/cm$^2$, the inventors found, by extrapolating data of the experiments, that radiant sensitivities of the fabricated PMTs more than that of the conventional PMTs can be obtained at, e.g., even several μg/cm$^2$. Especially in the case the base substrate of a photocathode surface is formed of aluminium (Al), high photosensitivities can be obtained even in a range of 5 μg/cm$^2$–10 μg/cm$^2$.

The Sb deposition weights were quantitatively determined by the following method.

Antimony (Sb) can be deposited on a nickel plate functioning as the base substrate by, e.g., the following method. First, a target made of Sb is placed on a heater as the evaporation source in a vacuum vessel. Eight sheets of nickel plates are set respectively at the same distance from the evaporation source. Then, the heater is turned on to vaporize the Sb. Then, based on a vaporizing amount of the Sb from the heater and a distance from the evaporation source to the nickel plates, a deposition weight of the Sb per a unit area can be easily given.

The evaporation of the Sb is not always uniform in all the directions, and the evaporation of all the Sb is not secured. Accordingly, it is difficult to measure an accurate deposition weight by the above-described indirect method. Then, to improve the reliability of the tests, the inventors, used the following direct method.

A evaporation source including a wire heater 101 and Sb target adhered to the wire heater 101 in a uniform thickness was prepared. The wire heater 101 was set vertical as shown in FIG. 1. Eight nickel plates 201–208 were set upright on a evaporation ring 102 which was rotatable around the wire heater 101. The respective nickel plates 201–208 were positioned at the same distance from the wire heater 101. A direct current was supplied to the wire heater 101 through electrodes 103, 104 with the evaporation ring 102 set on rotation, so that the Sb was slowly evaporated. Thus the Sb could be deposited evenly on all the nickel plates 201–208.

A deposition weight of the Sb was measured as follows. Weights of the 8 sheets of nickel plates before the deposition were measured by an electron balance type measurement device of high precision with the zero point adjusted. Then the Sb was evaporated by the method of FIG. 1. A deposition weight could be controlled with high precision by adjusting a deposition amount of the solid Sb to the wire heater, and also by adjusting evaporation times or heating temperatures with the wire heater with the same adhesion amount. Then, the 8 nickel plates with the Sb adhered to were measured by the electron balance type measurement device with the zero point adjusted.

A deposition weight of the Sb per a unit area could be determined based on differences of weights of the measured nickel plates between before and after the deposition, and deposition areas of the nickel plates. The data of FIGS. 2, 3 and 4 were thus obtained.

It is preferred that the base substrate, which is in direct contact with the Sb thin layer, is formed of, e.g., Ni, Al or stainless steel. K, Ca, Rb and Na are suitable as the alkali metals. Thus, a reflection mode alkali photocathode of high radiant sensitivity can be realized with high yields.

The present invention will become more fully understood from the detailed description given hereinbelow and the accompanying drawings which are given by way of illustration only, and thus are not to be considered as limiting the present invention.

Further, the scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art form this detailed description.

DESCRIPTION OF THE PREFERRED EXAMPLES

Figure 7:
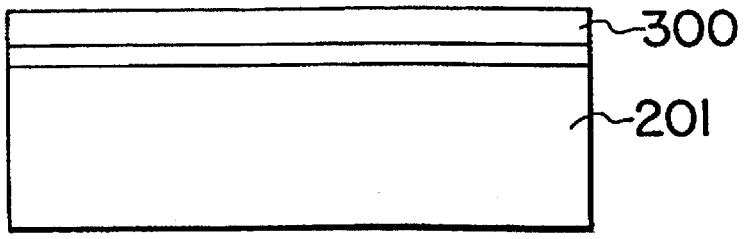
FIG. 7 is a side view of a photocathode according to the present invention.

This invention will be explained below in more detail. The reflection mode alkali photocathode according to this invention comprises a base substrate 201 of Ni or others, and a photosensitive layer 300 containing Sb activated by alkali metals, such as cesium (Cs), potassium (K), sodium (Na) and rubidium (Rb). See. FIG. 7. A deposition weight of the Sb is below 100 μg/cm$^2$.

A photomultiplier having such reflection mode alkali photocathode is fabricated as follows. A glass vacuum vessel is prepared, and Sb is evaporated on a part for the reflection mode photocathode to be formed on. Sb is deposited as a thin film in deposition weight of below 100 μg/cm$^2$, or a porous film. Subsequently when in the photocathode surface portion made of a bialkali, Cs, Na, K are introduced to activate the photocathode surface portion, and the photocathode is sintered. Temperature conditions and times for the activation and the sintering are set suitably as known. Incidentally, a temperature is selected from 140°–220° C.

The other members of a photomultiplier (PMT), such as dynodes, microchannel plates, an anode, etc. are mounted in the conventional procedure. When the reflection mode alkali photocathode is formed, and the members are mounted, the vacuum vessel is closed, and the reflection mode alkali photocathode is finished.

Figure 5:
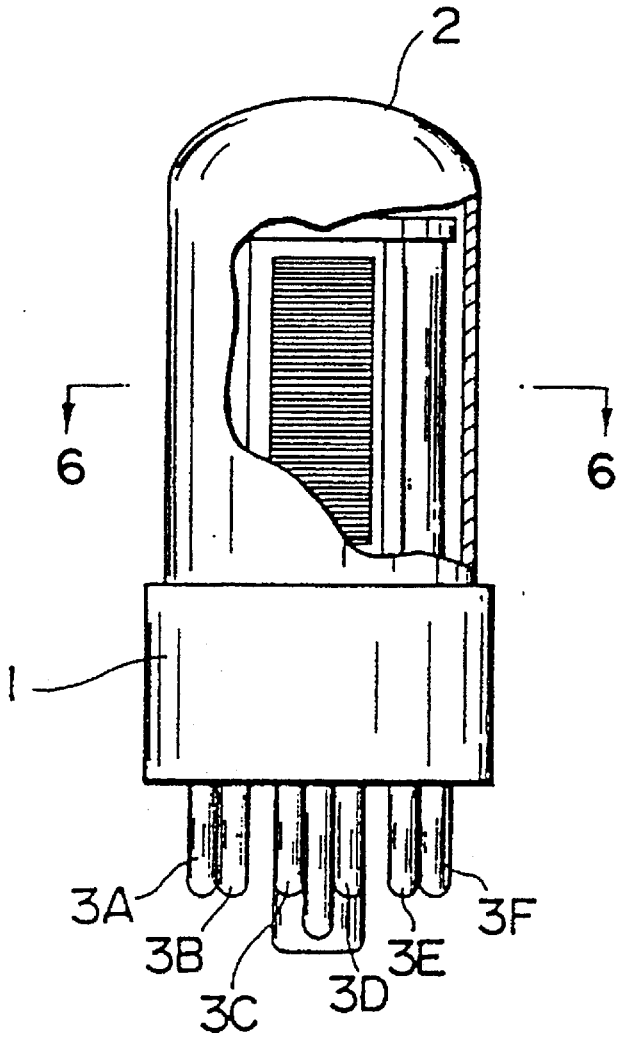
FIG. 5 is a side view of a side-on PMT with the glass bulb partially broken.
Figure 6:
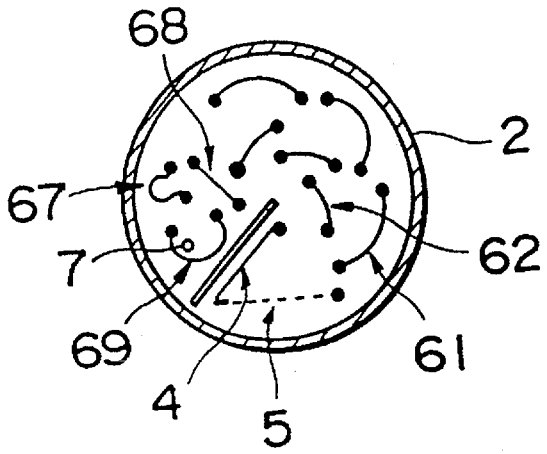
FIG. 6 is a sectional view of the PMT of FIG. 5 along the line $X_1$–$X_2$.

A structure of a photomultiplier having the reflection mode alkali photocathode according to this invention is shown in FIGS. 5 and 6. As shown in FIG. 5, a glass bulb 2 is mounted on a support 1, and stem pins 3A–3F are provided downwardly on the support 1. As in the sectional view along the line 6—6 of FIG. 5, the glass bulb 2 houses a cathode 4 of a nickel base substrate with a photocathode surface formed on, a metal mesh electrode 5 provided on the front surface of the glass bulb 2, a circular cage-type 9-stage dynodes 61–69, and an anode 7. In this PMT light passing the metal mesh electrode 5 enters the cathode 4. Photoelectron thus emitted impinge on the respective dynodes 61, 62, . . . , . . . , 68, 69 one after another, and a number of the electrons is rapidly increased by the emission of secondary electrons. Then all the electrons are collected by the anode 7 and are taken outside as electric signals through one of the stem pins 3A–3F.

Next, examples of fabrication for tests of the bialkali photocathode surface will be explained. In all the examples, the conditions, such as temperatures, vacuum degrees, times, etc. are the same irrespective of deposition weights of Sb. In the examples, base substrates were Ni plates having the surfaces (weakly) oxidized, and Sb layers were formed on the rinsed oxidized surfaces.

In the examples, the Sb layers were deposited in 6 different thicknesses (deposition weights) from 15–230 μg/cm$^2$. Then K, Cs were introduced to activate the Sb layers to obtain a bialkali (K-Cs-Sb) photocathode. Twenty photocathode surfaces (totally 120) were prepared at the respective set deposition weights.

Figure 2:
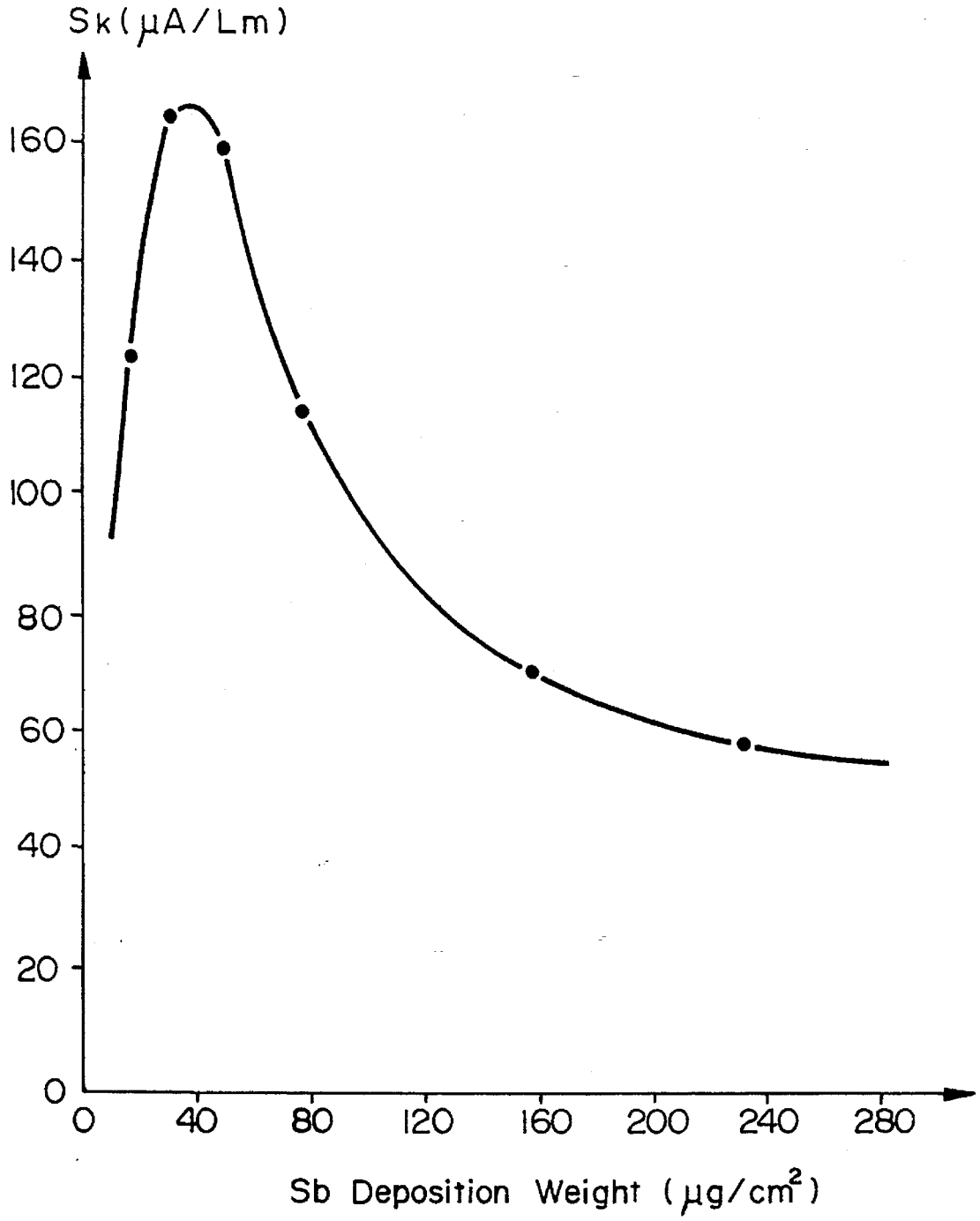
FIG. 2 is a graph of the radiant sensitivity characteristic of one bialkali photocathode fabricated for the tests.

The sample photocathode surfaces exhibited the radiant sensitivity characteristic of FIG. 2. An average luminous sensitivity is below about 80(μA/1 m) at a deposition weight of Sb of above 100 μg/cm$^2$. At a deposition weight of 20–80 μg/cm$^2$, an average luminous sensitivity is above 115 (μA/1 m).

As apparent in FIG. 2, the deposition of Sb in 40 μg/cm$^2$ provides much improvement of the radiant sensitivity. The sample photocathode surfaces exhibited a maximum value of 193 μA/1 m. A 150 μA/1 m radiant sensitivity could be stably realized. This high sensitivity ranged widely from the near infrared radiation to the ultraviolet radiation.

Furthermore, the inventors fabricated for test bialkali photocathode surfaces, using nickel, stainless steel and aluminium as the base substrates, and potassium, cesium, rubidium, etc. as the alkali metals.

Sample A: A nickel plate having the surface weakly oxidized was used, and K-Cs was used as the alkali metals.

Sample B: A nickel plate having the surface non-oxidized, and K-Cs was used as the alkali metals.

Sample C: A nickel plate having the surface oxidized, and Rb-Cs was used as the alkali metals.

Sample D: A stainless steel (non-magnetic material) plate which has undergone no oxidizing step, and K-Cs was used as the alkali metals.

Sample E: An aluminium plate which has undergone no oxidizing step, and K-Cs was used as the alkali metals.

Five PMTs were prepared for each of 10, 20, 50, 80 and 160 μg/cm$^2$ Sb deposition weights of each of Samples A, B, D and E. Three PMTs were prepared for each of the above-stated Sb deposition weights for Sample C. Average radiant sensitivities were determined.

Figure 3:
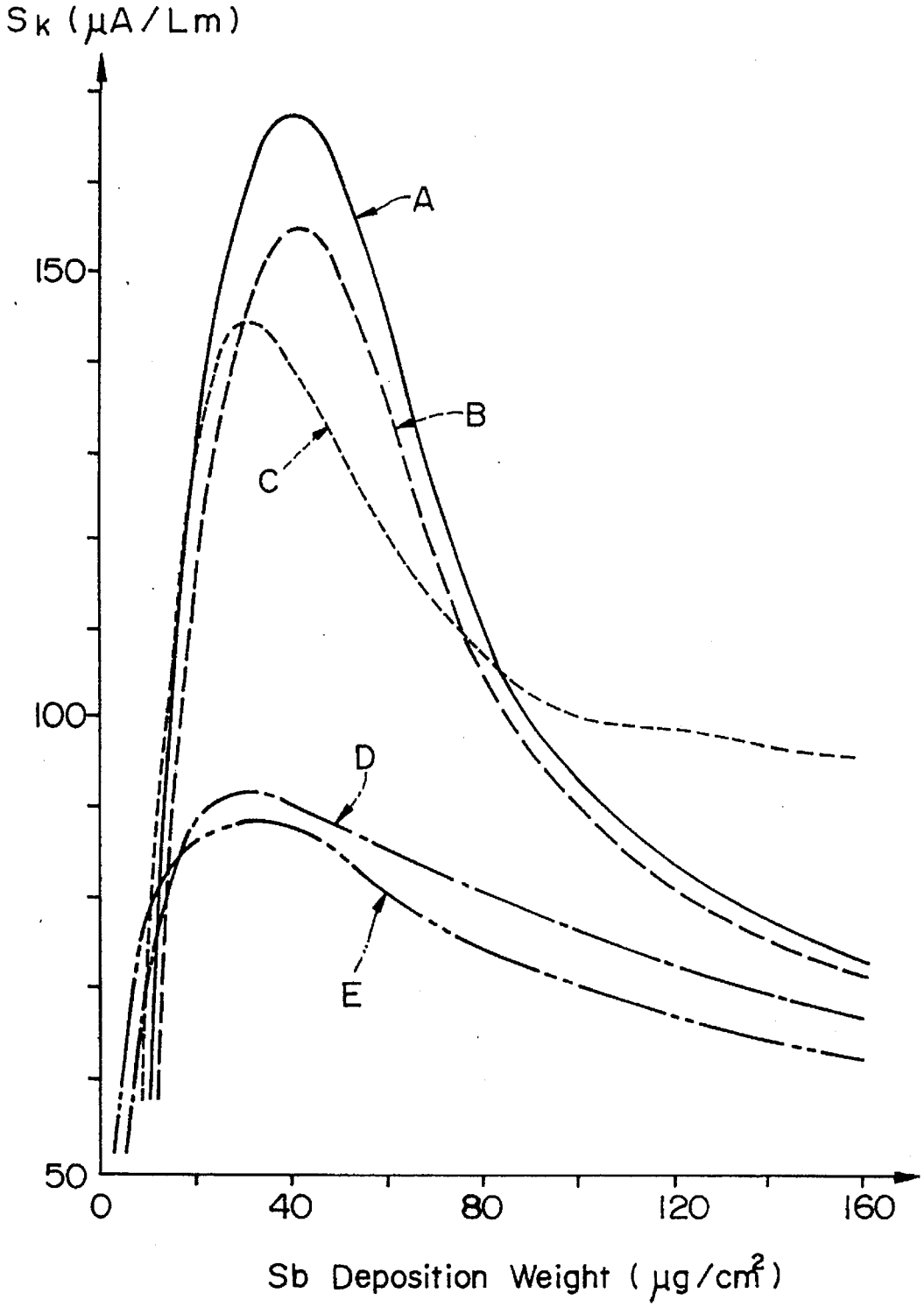
FIG. 3 is a graph of the radiant sensitivity characteristic of another bialkali photocathode fabricated for the tests.

The results are shown in FIG. 3. As shown in FIG. 3, in the cases that the base substrates are formed of nickel and stainless steel, high radiant sensitivities can be obtained at an Sb deposition weight of 10–100 μg/cm$^2$. In the case that the base substrate is formed of aluminium, a high sensitivity can be obtained at 5–100 μg/cm$^2$.

In the samples, as shown in FIG. 7, one substrate 201, out of all substrates 201–208 (see FIG. 1) was an Al plate having Al deposited on the surface, and Sb layer were 300 was deposited on the rinsed surfaces of the Al plate.

In the examples, the Sb layers were deposited in 7 different thicknesses (deposition weights) from 15–205 μg/cm$^2$. Then Na, K, Cs were introduced into to activate the Sb layers to obtain a multialkali (Cs-Na-K-Sb) photocathode. Five photocathode (totally 35) were prepared at the respective set deposition weights.

Figure 4:
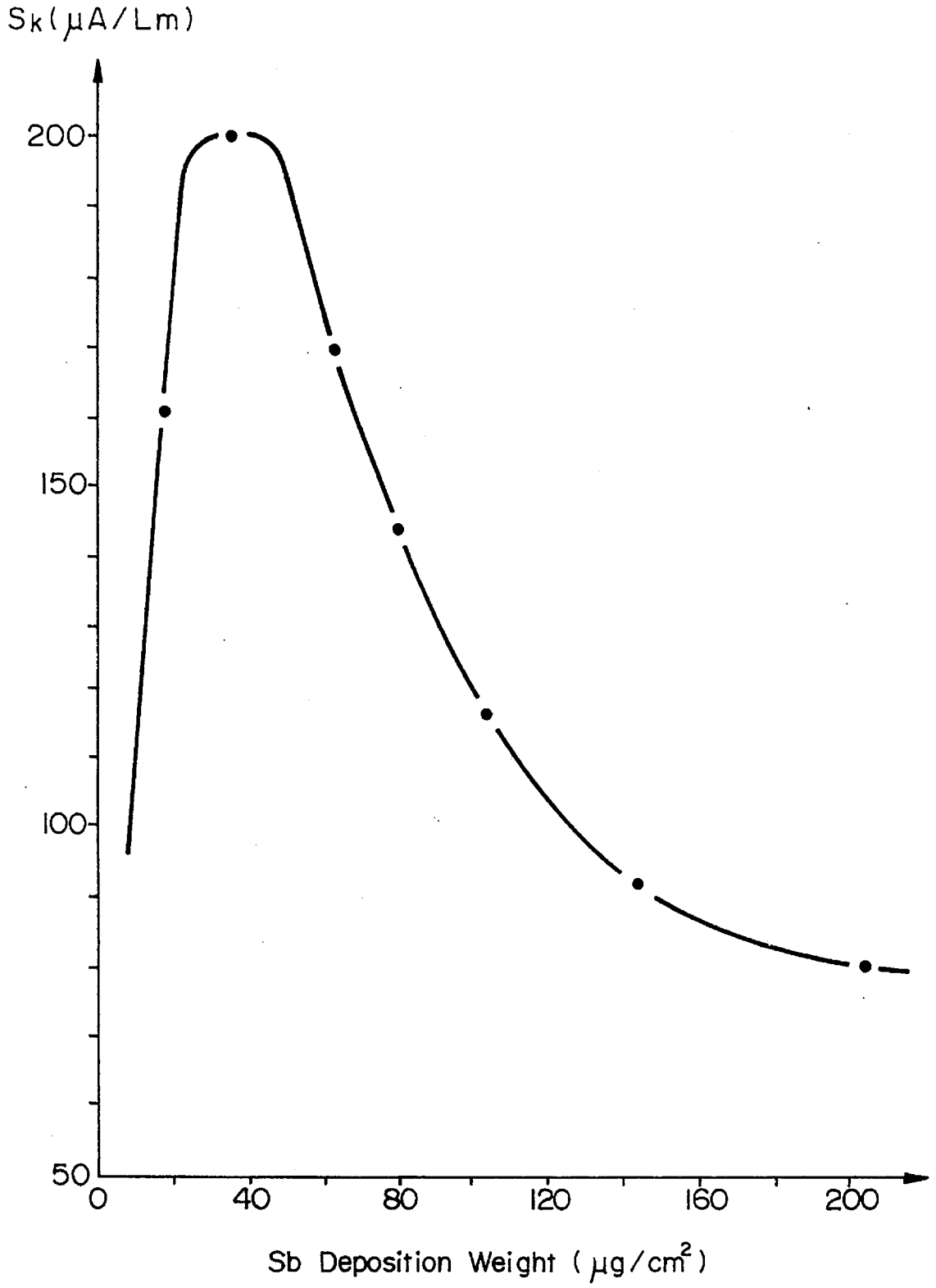
FIG. 4 is a graph of the radiant sensitivity characteristic of one of the multialkali photocathode surfaces fabricated for the tests.

The sample photocathode surfaces exhibited the radiant sensitivity characteristic of FIG. 4. An average luminous sensitivity is below about 120(μA/1 m) at a deposition weight of Sb of above 100 μg/cm$^2$. At a deposition weight of 20–80 μg/cm$^2$, an average luminous sensitivity is above 140–150 (μA/1 m).

As apparent in FIG. 4, the deposition weight of Sb in about 40 μg/cm$^2$ can attain especially much improvement of the radiant sensitivities. In the samples, radiant sensitivities of about 200 μA/1 m can be stably realized. The high radiant sensitivities widely range from the near infrared radiation to the ultraviolet radiation. It is apparent from the examples and the test results that base substrates of nickel, stainless, aluminium or others can be used in the multialkali photocathode surface.

Figure 1:
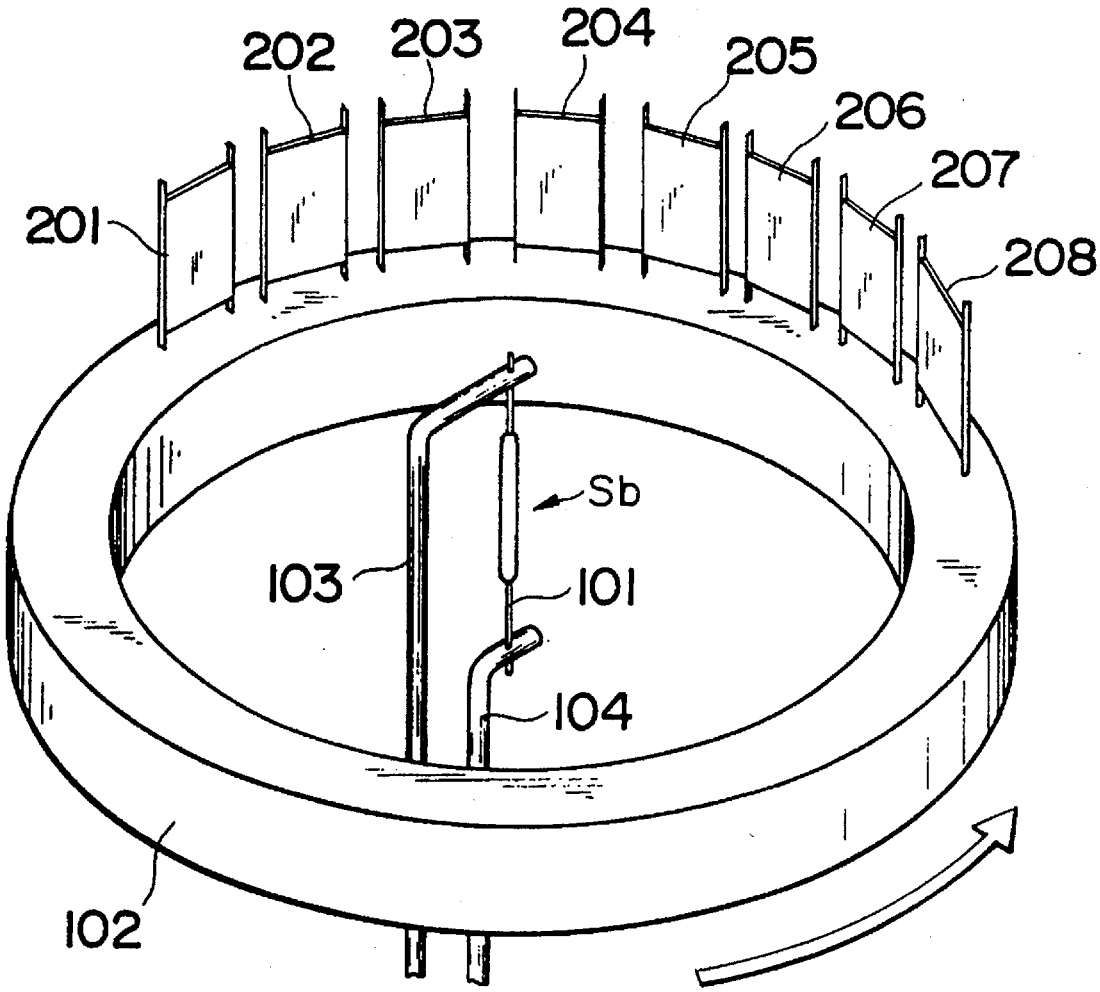
FIG. 1 is a view of the device for evaporating Sb used by the inventors of this invention for high precision of measuring the deposition weights of the Sb.

The alkali photocathode according to this invention includes the Sb layer in the deposition weight of below 100 μg/cm$^2$, whereby reflection mode alkali photocathode of a high sensitivity can be realized with high yields. As alakli metals used in the photocathode surface according to this invention, some elements other than cesium, potassium, rubidium and sodium are available. As the base substrate of the photocathode surface according to this invention, some metals other than aluminium, nickel and stainless are available. Although the inventors have not obtained experimental data on all combinations of these materials, the results of their experiments on combinations of typical materials showed characteristics common to the experiments, i.e., the Sb deposition weight dependency of the radiant sensitivity as shown in FIGS. 1–3.

Accordingly the photocathodes which are formed of not only the experimentally proved materials, but also of materials equivalent to these materials, and which have Sb deposition weights of below 100 μg/cm$^2$ are included in the coverage of this invention.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims..

What is claimed is:

1. A reflection mode alkali photocathode comprising:

a Ni substrate; and a plurality of alkali metals and antimony disposed directly on said Ni substrate, wherein a deposition weight of said antimony is greater than 30 μg/cm$^2$ and less than 100 μg/cm$^2$.

2. A reflection mode alkali photocathode according to claim 1, wherein a surface of said substrate is oxidized.

* * * * *